US011192686B2

(12) United States Patent
Ramos et al.

(10) Patent No.: US 11,192,686 B2
(45) Date of Patent: Dec. 7, 2021

(54) BOX FOR PACKAGING CORE SAMPLES

(71) Applicants: Flavio de Barros Ramos, Porto Alegre (BR); Daniel Bortowski Carvalho, Crixas (BR)

(72) Inventors: Flavio de Barros Ramos, Porto Alegre (BR); Daniel Bortowski Carvalho, Crixas (BR)

( * ) Notice: Subject to any disclaimer, the term of this patent is extended or adjusted under 35 U.S.C. 154(b) by 109 days.

(21) Appl. No.: 15/516,665

(22) PCT Filed: Sep. 29, 2015

(86) PCT No.: PCT/BR2015/050163
§ 371 (c)(1),
(2) Date: Nov. 3, 2017

(87) PCT Pub. No.: WO2016/049723
PCT Pub. Date: Apr. 7, 2016

(65) Prior Publication Data

US 2018/0057205 A1 Mar. 1, 2018

(30) Foreign Application Priority Data

Oct. 3, 2014 (BR) ..... 1020140247009

(51) Int. Cl.
*B65D 21/02* (2006.01)
*B65D 25/04* (2006.01)
(Continued)

(52) U.S. Cl.
CPC ..... *B65D 21/0202* (2013.01); *B65D 21/0212* (2013.01); *B65D 25/04* (2013.01);
(Continued)

(58) Field of Classification Search
CPC ..... B65D 21/0202; B65D 21/0212; B65D 81/261; B65D 25/2897; B65D 71/70
See application file for complete search history.

(56) References Cited

U.S. PATENT DOCUMENTS 3,196,229 A 7/1965 Glass
3,272,329 A 9/1966 Mehalov
(Continued)

FOREIGN PATENT DOCUMENTS

AU 2009222632 4/2010
AU 2010200897 5/2011
(Continued)

OTHER PUBLICATIONS

Examination Report No. 1 dated Jul. 1, 2019 in corresponding Australian Patent Application No. 2015327707.
(Continued)

*Primary Examiner* — Andrew T Kirsch
(74) *Attorney, Agent, or Firm* — Womble Bond Dickinson (US) LLP

(57) ABSTRACT

A box for packaging core samples from rock drilling is provided, used in particular in the field of mineral sampling from geological exploration activities for subsequent analysis. The box is defined by a structure formed by a single body produced by injection molding of a thermoplastic material which includes female fittings and male fittings for laterally interlocking the boxes, closing and locking devices for the cover on the box, anatomical transport handles, openings and channels for draining liquid fractions and texturing for identifying the collected samples.

9 Claims, 3 Drawing Sheets

(51) Int. Cl.

| | |
|---|---|
| ***B65D 81/26*** | (2006.01) |
| ***E21B 25/00*** | (2006.01) |
| ***B65D 25/28*** | (2006.01) |
| ***B65D 43/02*** | (2006.01) |
| ***B65D 85/00*** | (2006.01) |

(52) U.S. Cl.
CPC ..... *B65D 25/2897* (2013.01); *B65D 43/02* (2013.01); *B65D 81/261* (2013.01); *B65D 85/70* (2013.01); *E21B 25/005* (2013.01)

(56) References Cited

U.S. PATENT DOCUMENTS

| | | | | |
|---|---|---|---|---|
| 3,424,334 | A * | 1/1969 | Goltz | B65D 21/0202 206/504 |
| 3,581,929 | A * | 6/1971 | Guenard | B65D 21/08 206/443 |
| 4,577,773 | A * | 3/1986 | Bitel | A47B 88/994 220/533 |
| 4,874,091 | A | 10/1989 | Forrest | |
| 4,899,874 | A * | 2/1990 | Apps | B65D 1/243 206/201 |
| 4,944,400 | A * | 7/1990 | Van Onstein | B65D 21/0202 206/509 |
| 4,959,199 | A * | 9/1990 | Brewer | A61C 19/00 206/439 |
| D424,941 | S | 5/2000 | Boutour | |
| 6,221,027 | B1 * | 4/2001 | Pitesky | A61B 5/411 206/538 |
| D593,325 | S | 6/2009 | Evans | |
| D671,146 | S | 11/2012 | Kathman | |
| 10,336,497 | B2 | 7/2019 | Keast | |
| 2004/0040873 | A1 * | 3/2004 | Koseki | A61B 50/362 206/363 |

FOREIGN PATENT DOCUMENTS

| | | |
|---|---|---|
| AU | 345951 | 12/2012 |
| AU | 354292 | 3/2014 |
| BR | MU8203018 | 7/2004 |
| BR | MU8601859 | 6/2008 |
| BR | 202012024078 | 7/2014 |
| CA | 49404 | 3/1982 |
| CN | 200974636 | 11/2007 |
| WO | WO-2011082563 | 7/2011 |
| WO | WO-2012088578 | 7/2012 |
| WO | 2014040123 | 3/2014 |
| WO | 2014197922 | 12/2014 |

OTHER PUBLICATIONS

International Search Report dated Oct. 20, 2015 in International Application No. PCT/BR2015/050163.

Written Opinion dated Oct. 20, 2015 in International Application No. PCT/BR2015/050163.

Core Case Sustainable Core Boxes, Adapt Core Shocks, Copyright 2020. https://corecase.com.br/en/produtos/core-shocks-adapt-en/.

Shandong Geological & Mineral Equipment Ltd. Corp., Drilling Explore Rock Mining Core Boxes With 4—Channel 1070*275*85mm, Copyright 2018-2020 core-tray.com, http://www.core-tray.com/sale-10780174-drilling-explore-rock-mining-core-boxes-with-4-channel-1070-275-85mm.html.

Discoverer Plastic Core Trays, www.cgsmule.com/Products/Core-Boxes/Discoverer-Plastic-Core-Trays.html.

Marton Geotechnical Services Ltd, Rhino Corebox, May 2019. https://www.mgs.co.uk/wp-content/uploads/2019/07/Rhino-Coreboxes-V1.0.pdf.

* cited by examiner

BOX FOR PACKAGING CORE SAMPLES

The present patent of invention relates to a box for packaging core samples from rock drilling, used in particular in the field of mineral sampling from geological exploration activities for subsequent analysis.

BACKGROUND OF THE INVENTION

Various containers designed with the specific purpose of facilitating the work of collecting, storing and transporting core samples are currently known in the art, which are generally formed by a cradle with inner partitions for separating the collected samples. Such boxes generate some drawbacks during use, especially to users, including: identification of collected material, box transport, cover locking and, particularly, the interlocking between the packaging boxes.

An example of a box for packaging core samples is disclosed in the Brazilian patent document MU8203018-9, which introduces a box intended for the safekeeping and storing of rock and mineral cylinders obtained in the geological survey for mineral exploration, consisting of an elongated tray injected into industrial plastic material having semi-cylindrical channels with external and internal side walls slightly angled outwards from the base, which attach to a surrounding edge that is both sturdy and structured to give rigidity to the assembly, provided with a sliding cover which slides inside one groove at the edge of the box, thus allowing the complete sealing of the assembly.

There is also the patent document BR 10 2013 019379 8 from this application applicant, filed 2013 Jul. 30, also titled "BOX FOR PACKAGING CORE SAMPLES", which introduces a packaging box formed from a hollow body with walls suitably spaced apart and structurally defined so as to form external and internal partitions with a larger thickness which define a plurality of compartments for accommodating the collected samples.

Despite the advances introduced in the box for packaging core samples proposed by the patent application BR 10 2013 019379 8, the applicant, continuing its studies on the subject, realized the need to develop a box for packaging provided with a cover with a closing and locking mechanism, as well as a box that allows the interlocking between the packaging boxes, since, if the boxes are not interlocked when stacked, they may move during transportation and end up falling and being damaged.

In this line of action, it has become essential for users of packaging boxes to provide a handy box that allows the identification of the core samples, locking of the cover, interlocking between the boxes, thus providing users with a versatile and practical packaging box.

Aiming to solve these drawbacks, the present invention proposes a box for packaging, particularly, core samples, in a differentiated design, which will meet the various requirements the nature of the use demands, that is, the secure interlocking between the boxes.

Another object of the present invention is to provide a box for packaging, particularly, core samples, in which the identification is carried out on a textured surface of the box, thus allowing improved adhesion of the marker pen, locking means between the cover and the box, thus preventing box from coming loose during transportation, and interlocking means between the boxes so as to prevent boxes from moving when they are stacked.

Advantageously, said box for packaging core samples presents great functionality, strength, versatility and economy, due to the excellent added technical qualities, the general characteristics of which differ from the other forms and models of boxes for packaging known in the current state of the art.

BRIEF DESCRIPTION OF THE INVENTION

Briefly, the present invention describes a plastic box having walls suitably spaced apart and structurally defined to form external walls and internal partitions defining compartments for accommodating the core samples. Said box is defined by a structure formed by a single body produced by injection molding of a thermoplastic material which comprises female fittings and male fittings for laterally interlocking the boxes, closing and locking means for the cover, anatomical transport handles, openings for draining liquid fractions and texturing for identifying the collected samples.

Schematic figures of a particular embodiment of the present invention are presented below, the dimensions and proportions of which are not necessarily the actual ones as the figures are intended only to present its various aspects informatively, and whose protective scope is determined solely by the scope of the appended claims.

DETAILED DESCRIPTION OF THE INVENTION

Figure 1:
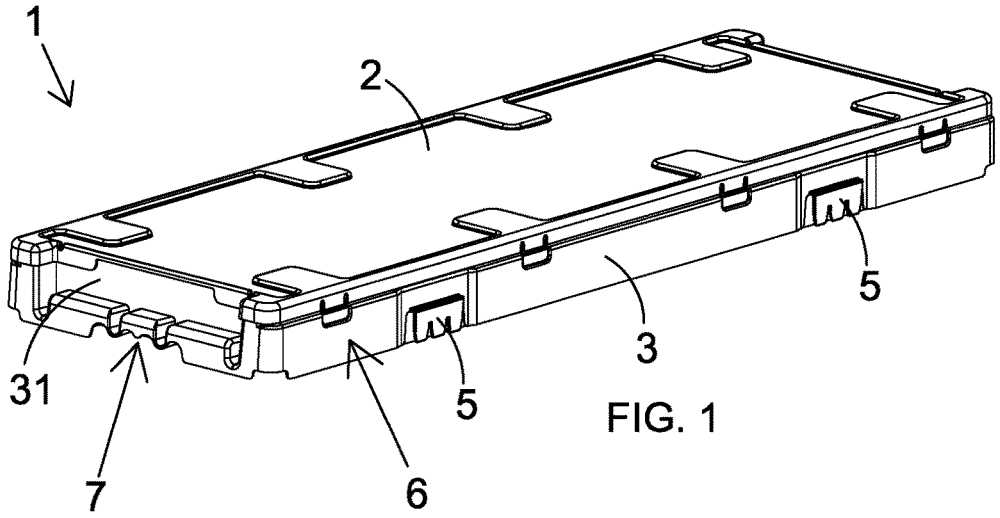
FIG. 1 illustrates a perspective view of the box (1) for packaging core samples with a cover (2) of the present invention.

As illustrated in the accompanying figures, the present invention concerns a plastic box (1) having walls (P) suitably spaced apart and structurally defined to form the external walls (3) and the internal partitions (30), defining compartments (C) for accommodating the core samples.

As shown in FIGS. 1 to 4, the box (1) is defined by a structure formed by a single body produced from injection molding of a thermoplastic material which comprises female fittings (4) and male fittings (5) for laterally interlocking the boxes (1), suitably arranged recesses on the side walls (3) to form slots (64), anatomical transport handles (7), openings (8) and channels (80) for draining liquid fractions and texturing for identifying the collected samples (not shown).

Figure 2:
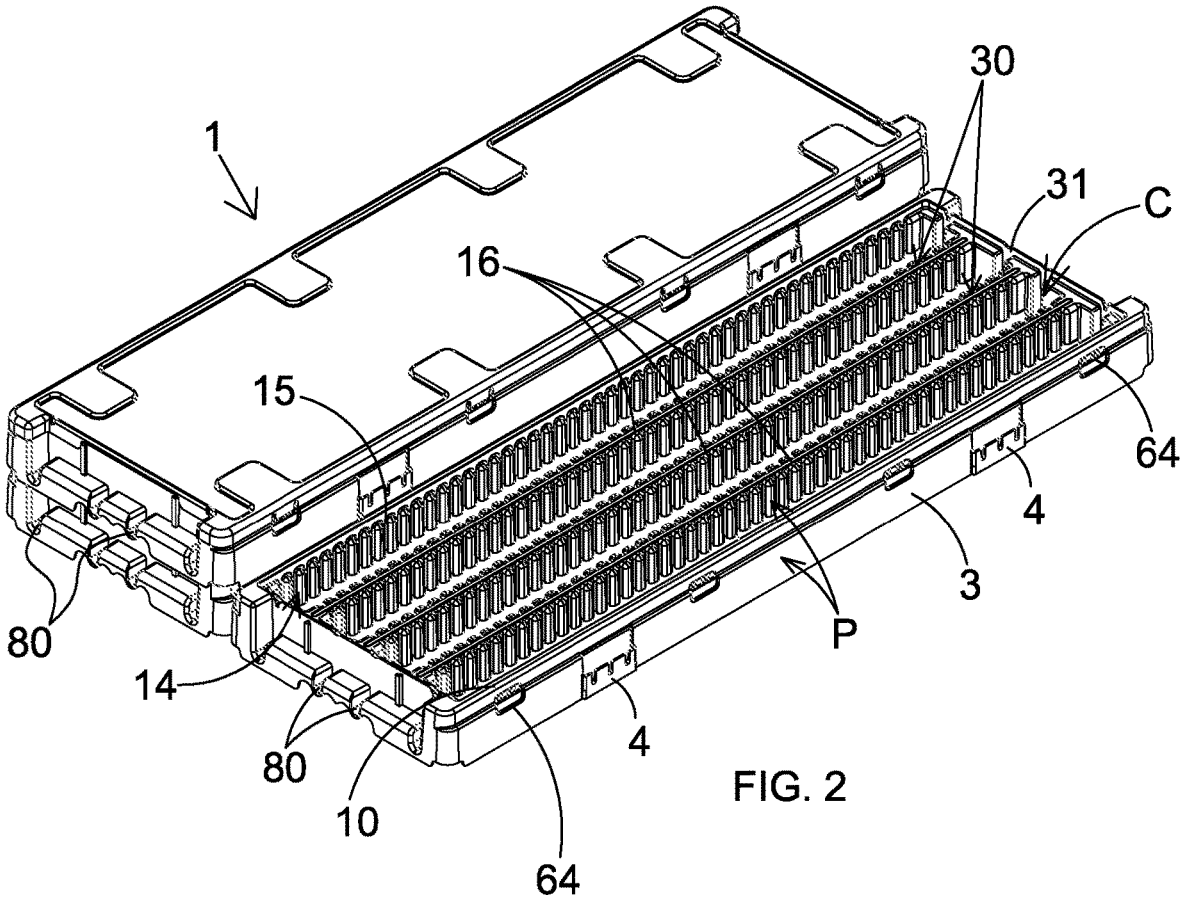
FIG. 2 illustrates an interlocking sequence of the boxes (1) conveniently fitted and stacked together.
Figure 3:
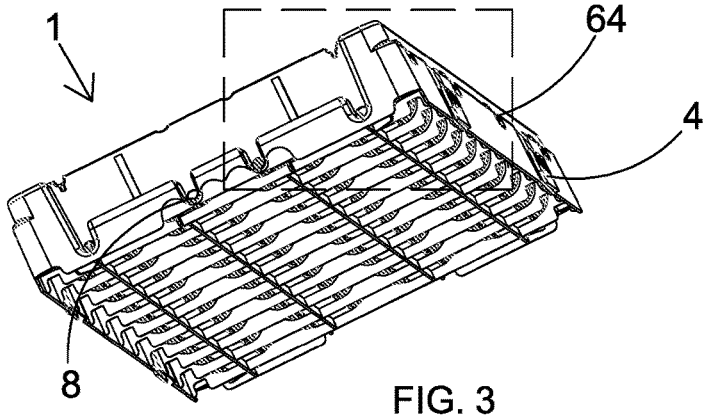
FIG. 3 illustrates a perspective view of the box (1) for packaging core samples of the present invention without the cover.
Figure 4:
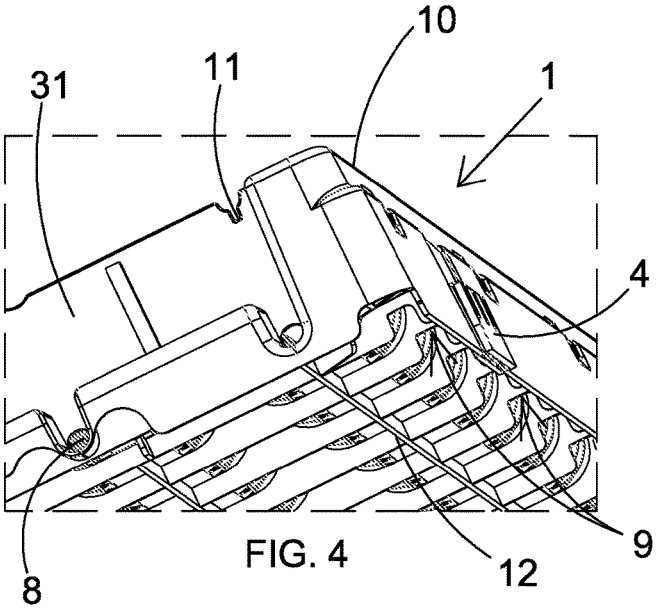
FIG. 4 illustrates an enlarged partial perspective view of the box (1) of the present invention.
Figure 4A:
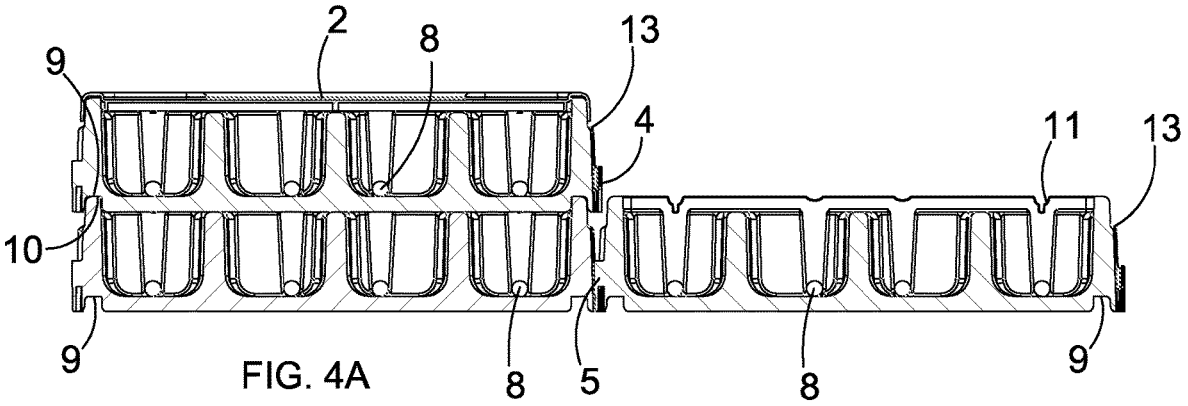
FIG. 4A illustrates a cross-sectional view of the interlocking sequence of the boxes (1) conveniently fitted and stacked together.

Fitting between the boxes (1) is promoted from the connection between a female fitting area (4), formed in one of the walls (3), and a male fitting area (5), formed on the other wall (3) to promote lateral interlocking between the boxes (1), as shown in FIGS. 2 and 4A.

When the boxes (1) are stacked so that they do not move during transportation, the boxes (1) comprise longitudinal channels (9) conveniently arranged in the lower portion of the box (1) so as to allow fitting thereof in the upper area (10) of the wall (3) of the box (1) placed immediately below, as shown in FIG. 4A.

Still referring to the stacking of the boxes, the box (1) comprises recesses (11) in the upper portion and in at least one of the walls (31) with a suitable embodiment to receive ribs (12) of the boxes (1), in order to define a positioning and locking area; advantageously, the association between the recesses (11) and the ribs (12) allows a better fit between the boxes (1). With respect to the recesses (11), they are substantially in a Y shape.

The walls (3) are also provided with a step (13) so that walls (3) are aligned when stacked, without increasing the width of the boxes (1) during stacking.

Figure 5:
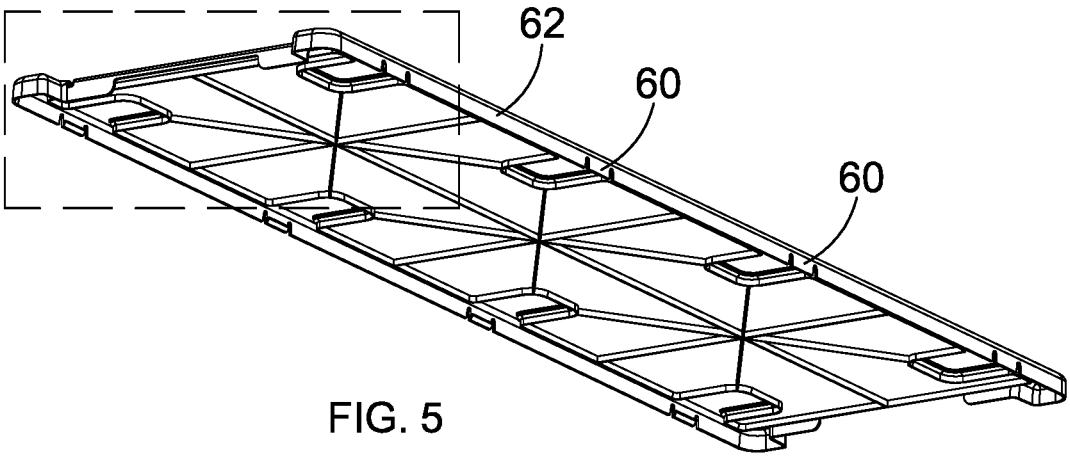
FIG. 5 illustrates a perspective view of the cover (2) to the box (1) of the present invention.
Figure 6:
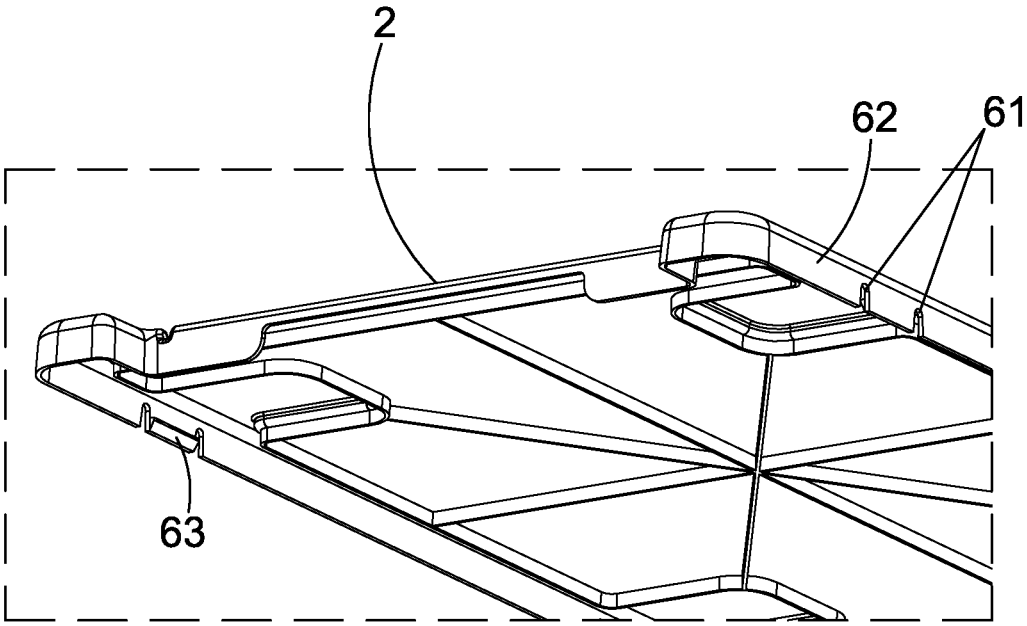
FIG. 6 illustrates an enlarged partial perspective view of the cover (2) to the box (1) of the present invention.

As shown in FIGS. 2, 5, and 6, the cover (2) has side edges (62) comprising recesses (61) that define flexing areas (60) in the locking areas of the cover (2) against the box (1), by means of projections (63) arranged inside the cover (2) that fit the slots (64) on the box (1) which, when combined, form a fitting and locking means (6). This way, when the cover (2) is pressed against the box (1), the recesses (61) allow bending of the flexing areas (60) to enable fitting and locking, by interference fit, of the cover (2) against the box (1).

The projection (63) has a substantially wedge-shaped configuration in order to allow bending of the flexing areas (60) out of the cover (2) to facilitate fit at the slots (64), whose flexing areas (60) simultaneously return to the starting position to lock the cover.

The box (1) further comprises anatomical handles (7), which enable a better engagement of the user's hands when moving the boxes (1) thus preventing the boxes from sliding away from the hands.

The box (1) comprises a plurality of grooves (15) in the vertical position and distributed along the compartments (C) extending partially from the upper areas (10 and 16) to a middle portion of the inner face (14) of the walls (3) and the partitions (30). Said grooves (15) allow fitting of partitions (not shown) for the samples (not shown) according to the size thereof. This way, the positioning of the sample (not shown) in the compartment (C) is possible according to the size of the sample.

The fact that the grooves (15) partially extend to the middle portion of the walls (3) and the partitions (30) avoid the accumulation of waste of the collected samples at the bottom of the compartments (C).

The openings (8) associated to the channels (80) allow the flow of liquids from the core samples (not shown) to the external environment.

Additionally, the upper areas (16) of the partitions (30) of the box (1) comprise texturing for identifying the collected samples, thus conferring improved adhesion of the marker pen (not shown).

A person skilled in the art will promptly infer, from the description and the drawings depicted, various ways of carrying out the invention without departing from the scope of the accompanying claims.

The invention claimed is:

1. A box for packing core samples therein and having a bottom, the core sample box comprising:

(a) a box-shaped injected plastic material body that includes the bottom and receives a cover when positioned to overlie the bottom of the body;

(b) walls suitably spaced apart and structurally defined to form external walls and defined to form interstitial space between the cover and the bottom;

(c) internal partitions positioned within the interstitial space within external walls of the body, extending substantially from the bottom of the box and projecting upwards, the internal partitions being substantially parallel to each other, defining compartments, and configured to accommodate the core samples when positioned in the body;

(d) one or more openings positioned in one or more external walls of the body and one or more channels underlying the plurality of compartments and positioned to allow the flow of liquids associated with the core samples when positioned inside of the box to an external environment;

(e) a lateral interlock that allows for a lateral connection to be formed with another of the box, the lateral interlock including female fitting areas formed in one of the walls, and male fitting areas formed on an opposite wall to facilitate lateral interlocking between the boxes, so that when the male fitting areas are connected with the female fitting areas, the lateral interlock provides restraint against lateral movement of the box when the box is interlocked laterally with an adjoining laterally extending box; and (f) a vertical interlock that allows for stacking of the box vertically with another box in such a manner so as to reduce movement of the boxes when stacked, the vertical interlock including:

(i) longitudinal channels located at a lower portion of the box, the longitudinal channels configured so as to allow fitting thereof onto an upper portion of the wall of another box placed immediately below and in contact with the box so as to form a first vertical interlock when one box is stacked upon another box; and (ii) recesses located in an upper portion of the box and at least one of the external walls, and (iii) ribs located in a lower portion of the box, the recesses configured for receiving the ribs so as to form a second vertical interlock when one box is stacked upon another box.

2. The box for packing core samples according to claim 1, wherein the walls further comprise a step-shaped portion so that the walls may be aligned when stacked without increasing the width of the boxes during stacking.

3. The box for packaging core samples according to claim 1, wherein the recesses are Y-shaped.

4. The box for packaging core samples according to claim 1, wherein the box further comprises anatomically-shaped handles that facilitate engagement of hands of a user when moving the boxes and act to prevent the boxes from sliding away from the hands.

5. The box for packaging core samples according to claim 1, wherein upper surfaces of the internal partitions comprise texturing for identifying the collected samples, the texturing providing improved adhesion for ink from a marker pen.

6. The box for packaging core samples according to claim 1, further comprising a plurality of grooves positioned vertically and distributed along the compartments, the grooves partially extending from the upper portion and upper surface of the wall to a middle portion of an inner face of the walls and the partitions.

7. A core sample box for packaging core samples when positioned therein, the core sample box comprising:

(a) a cover;

(b) a body having a bottom and walls suitably spaced and structurally configured so as to form external walls, the cover being positioned to overlie the bottom of the body;

(c) internal partitions defining compartments and configured to accommodate core samples when positioned in the body, the internal partitions extending from the bottom of the box and projecting upwards a length greater than the middle portion of the walls and being substantially parallel to each other so as to define the compartments for accommodating the core samples;

(d) one or more openings positioned in one or more external walls of the body and one or more channels underlying the plurality of compartments and positioned to allow the flow of liquids associated with the core samples when positioned inside of the box to an external environment; and (e) a locking mechanism for closing and locking the cover to the body, the locking mechanism including recesses and a plurality of flexing areas defined between the recesses in relief and positioned on a side edge of the cover so as to define a bending region having a projection and a plurality of slots configured and positioned on the walls of the housing so that when the cover is pressed against the box so as to fit and lock the box, the recesses allow bending of the flexible areas to enable fitting and locking by an interference fit.

8. The box for packaging core samples according to claim 7, wherein the projection is substantially wedge-shaped in order to allow the bending of the flexing areas out of the cover so as to facilitate the fit at the slots whose flexing areas simultaneously return to the starting position to lock the cover.

9. A core sample box for packaging core samples when positioned therein, the core sample box comprising:

a cover;

a body having a bottom and walls suitably spaced and structurally configured so as to form external walls, the cover being positioned to overlie the bottom of the body;

internal partitions defining compartments and configured to accommodate core samples when positioned in the body, the internal partitions extending from the bottom of the box and projecting upwards a length greater than the middle portion of the walls and being substantially parallel to each other so as to define the compartments for accommodating the core samples, one or more openings positioned in one or more external walls of the body;

one or more channels in the body of the box underlying the plurality of compartments and positioned to allow the flow of liquids associated with the core samples, when positioned inside of the body of the box, to an external environment; and a locking mechanism for closing and locking the cover to the body, the locking mechanism comprising recesses and a plurality of flexing areas defined between the recesses in relief and positioned on a side edge of the cover so as to define a bending region, the bending region having a projection and a plurality of slots configured and positioned on the walls of the housing so that when the cover is pressed against the box so as to fit and lock the box, the recesses allow bending of the flexible areas to enable fitting and locking by an interference fit.

* * * * *